US009489877B2

(12) United States Patent
Wang et al.

(10) Patent No.: US 9,489,877 B2
(45) Date of Patent: Nov. 8, 2016

(54) DETECT CIRCUIT AND DISPLAY DEVICE

(71) Applicant: Shenzhen China Star Optoelectronics Technology Co., Ltd., Shenzhen, Guangdong (CN)

(72) Inventors: Zui Wang, Shenzhen (CN); Jinbo Guo, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 44 days.

(21) Appl. No.: 14/435,466

(22) PCT Filed: Jan. 12, 2015

(86) PCT No.: PCT/CN2015/070541

§ 371 (c)(1),
(2) Date: Apr. 14, 2015

(87) PCT Pub. No.: WO2016/106831

PCT Pub. Date: Jul. 7, 2016

(65) Prior Publication Data

US 2016/0189580 A1 Jun. 30, 2016

(51) Int. Cl.
*G09G 3/00* (2006.01)

(52) U.S. Cl.
CPC ..... *G09G 3/006* (2013.01); *G09G 2300/0426* (2013.01); *G09G 2330/12* (2013.01)

(58) Field of Classification Search
None
See application file for complete search history.

(56) References Cited

U.S. PATENT DOCUMENTS

2007/0234151 A1* 10/2007 Hsu ..... G09G 3/006 714/726
2014/0111407 A1* 4/2014 Kwon ..... G09G 3/006 345/82

* cited by examiner

*Primary Examiner* — Kenneth B Lee, Jr.
(74) *Attorney, Agent, or Firm* — Andrew C. Cheng

(57) ABSTRACT

A detecting circuit comprises a first to a third detecting line, a first and a second control line, and a first to a sixth transistor set. Each transistor set comprises a first and a second transistor, a control terminal thereof couples to the first and the second control line, respectively, a first terminal thereof couples to one of the first to the third detecting line, a second terminal thereof couples to the second terminal of the second transistor in the same transistor set. The connection nodes compose a dot set [(3,3), (2,2), (3,1), (2,3), (3,2), (2,1)], wherein the numerals 1-3 represent the first to the third detecting line, a first and a second numeral of a dot represent that a first terminal of the first and the second transistor connect to the detecting lines represented by the numerals, respectively.

10 Claims, 5 Drawing Sheets

DETECT CIRCUIT AND DISPLAY DEVICE

CROSS REFERENCE TO RELATED APPLICATIONS

This application claims priority to Chinese Application Serial No. 201410849907.5 filed Dec. 31, 2014, named as "A Detecting Circuit and Display Device", content of which is incorporated herein by reference.

FIELD OF THE INVENTION

The present invention relates to an electronic field, and more particularly to a detect circuit and display device.

BACKGROUND OF THE INVENTION

Usually, in a conventional layout design of a display panel, an outside circuit such as a shorting bar is designed at outside of a pixel circuit, and a plurality of scan lines are leaded to the outside circuit in accordance with whether a sequence number of the leaded scan line is odd or even, respectively. That is, the scan lines with odd sequence numbers in the whole display panel are short-circuited at outside of the display panel, and the scan lines with even sequence numbers in the whole display panel are short-circuited at outside of the display panel. This kind of design is for checking whether a short circuit or an open circuit exists in the display panel through providing different electronic signals to the scan lines with odd sequence numbers and even sequence numbers, or for further checking defects of other types when cooperated with different data signals, in a testing stage of a TFT (Thin Film Transistor) manufacturing process. The shorting bar is also used in a lighting detection stage during liquid crystal cell manufacturing process, and is disconnected or removed after the detection so that the normal display of a finished product would not be affected.

As shown in FIG. 1, if the charging scan line 103 and the charge sharing scan line 104 of the same line are short-circuited (the second short-circuited position 102 or the first short-circuited position 101), both of them are with odd sequence numbers or even sequence numbers because the charge sharing scan line is coupled to the charge scan line which is the one after the charging scan line 103 for an $N^{th}$ even number (N is an integer), so that the short circuit cannot be detected in the TFT manufacturing process by only using the method of leading the scan lines with odd or even sequence number to the shorting bar. The short circuit therein can only be detected by the method of cell lighting or even the method of finished product detecting, which results in decrease of production yield.

SUMMARY OF THE INVENTION

A technique problem to be solved by the present invention is to provide a detecting circuit and display device to detect the abnormal existed in the display device effectively and precisely so as to improve the yield of display device.

In order to achieve the object above, an embodiment of the present invention provides the technique solution as below:

The present invention provides a detecting circuit for detecting abnormal in a display device, wherein the detecting circuit comprises a first detecting line, a second detecting line, a third detecting line, a first control line, a second control line, a first transistor set, a second transistor set, a third transistor set, a fourth transistor set, a fifth transistor set and a sixth transistor set, the first to the sixth transistor set is coupled to a first scan line, a second scan line, a third scan line, a fourth scan line, a fifth scan line or a sixth scan line, wherein each of the transistor sets comprises a first transistor and a second transistor, a control terminal of each first transistor is coupled to the first control line, a first terminal of each first transistor is coupled to one of the first to the third detecting line, a control terminal of each second transistor is coupled to the second control line, a first terminal of each second transistor is coupled to one of the first to the third detecting line, a second terminal of each first transistor is coupled to a second terminal of the second transistor in a same transistor set comprising the coupled first transistor, and is coupled to one of the first to the sixth scan line, each transistor set corresponds to one of the scan lines, and a plurality of connection nodes where the first terminals of the first and second transistors of the first to the sixth transistor set being coupled to the first to the third detecting line compose a set of predetermined point which is [(3,3), (2,2), (3,1), (2,3), (3,2), (2,1)], wherein, in the set of predetermined point, the numerals 1, 2 and 3 represent the first to the third detecting line, a first numeral of a point represents that the first terminal of the first transistor is coupled to the detecting line represented by the first numeral, and a second numeral of the point represents that the first terminal of the second transistor is coupled to the detecting line represented by the second numeral, and abnormal of the display device is detected by controlling to turn on the first or the second transistor through the first and the second control lines.

Wherein, the first terminals of the first and the second transistors of the first transistor set are coupled to the third detecting line, the second terminals of the first and the second transistors of the first transistor set are coupled to the first scan lines, the first terminals of the first and the second transistors of the second transistor set are coupled to the second detecting line, the second terminals of the first and the second transistor of the second transistor set are coupled to the second scan line, the first terminal of the first transistor of the third transistor set is coupled to the third detecting line, the first terminal of the second transistor of the third transistor set is coupled to the first detecting line, the second terminals of the first and the second transistors of the third transistor set are coupled to the third scan line, the first terminal of the first transistor of the fourth transistor set is coupled to the second detecting line, the first terminal of the second transistor of the fourth transistor set is coupled to the third detecting line, the second terminals of the first and the second transistors of the fourth transistor set are coupled to the fourth scan line, the first terminal of the first transistor of the fifth transistor set is coupled to the third detecting line, the first terminal of the second transistor of the fifth transistor set is coupled to the second detecting line, the second terminals of the first and the second transistors of the fifth transistor set are coupled to the fifth scan line, the first terminal of the first transistor of the sixth transistor set is coupled to the second detecting line, the first terminal of the second transistor of the sixth transistor set is coupled to the first detecting line, and the second terminals of the first and the second transistors of the sixth transistor set are coupled to the sixth scan line.

Wherein, the first to the sixth transistor sets are aligned along a predetermined direction sequentially, and the first to the sixth scan lines are aligned along the predetermined direction sequentially.

Wherein, the first and the second transistors of the first to the sixth transistor set are N-type transistors, and the control terminal, the first terminal and the second terminal of the first and the second transistors are gate, source and drain of the N-type transistors, respectively.

Wherein, the first to the sixth scanline is a first to a sixth charging scan line.

The present invention further provides a display device comprising a first scan line, a second scan line, a third scan line, a fourth scan line, a fifth scan line, a sixth scan line, a first detecting line, a second detecting line, a third detecting line, a first control line, a second control line, a first transistor set, a second transistor set, a third transistor set, a fourth transistor set, a fifth transistor set and a sixth transistor set, the first to the sixth transistor set being coupled to the first to the sixth scan line, wherein each of the transistor sets comprises a first transistor and a second transistor, a control terminal of each first transistor is coupled to the first control line, a first terminal of each first transistor is coupled to one of the first to the third detecting line, a control terminal of each second transistor is coupled to the second control line, a first terminal of each second transistor is coupled to one of the first to the third detecting line, a second terminal of each first transistor is coupled to a second terminal of the second transistor in a same transistor set comprising the coupled first transistor, and is coupled to one of the first to the sixth scan line, each transistor set corresponds to one of the scan lines, and a plurality of connection nodes where the first terminals of the first and second transistors being coupled to the first to the third detecting line compose a set of predetermined point which is [(3,3), (2,2), (3,1), (2,3), (3,2), (2,1)], wherein, in the set of predetermined point, the numerals 1, 2 and 3 represent the first to the third detecting line, a first numeral of a point represents that the first terminal of the first transistor is coupled to the detecting line represented by the first numeral, and a second numeral of the point represents that the first terminal of the second transistor is coupled to the detecting line represented by the second numeral, and abnormal of the display device being detected by controlling to turn on the first or the second transistor through the first and the second control lines.

Wherein, the first terminals of the first and the second transistors of the first transistor set are coupled to the third detecting line, the second terminals of the first and the second transistors of the first transistor set are coupled to the first scan lines, the first terminals of the first and the second transistors of the second transistor set are coupled to the second detecting line, the second terminals of the first and the second transistor of the second transistor set are coupled to the second scan line, the first terminal of the first transistor of the third transistor set is coupled to the third detecting line, the first terminal of the second transistor of the third transistor set is coupled to the first detecting line, the second terminals of the first and the second transistors of the third transistor set are coupled to the third scan line, the first terminal of the first transistor of the fourth transistor set is coupled to the second detecting line, the first terminal of the second transistor of the fourth transistor set is coupled to the third detecting line, the second terminals of the first and the second transistors of the fourth transistor set are coupled to the fourth scan line, the first terminal of the first transistor of the fifth transistor set is coupled to the third detecting line, the first terminal of the second transistor of the fifth transistor set is coupled to the second detecting line, the second terminals of the first and the second transistors of the fifth transistor set are coupled to the fifth scan line, the first terminal of the first transistor of the sixth transistor set is coupled to the second detecting line, the first terminal of the second transistor of the sixth transistor set is coupled to the first detecting line, and the second terminals of the first and the second transistors of the sixth transistor set are coupled to the sixth scan line.

Wherein, the first to the sixth transistor sets are aligned along a predetermined direction sequentially, and the first to the sixth scan lines are aligned along the predetermined direction sequentially.

Wherein, the first to the sixth scan line is a first to a sixth charging scan line, the display device further comprises a first to a sixth charge sharing scan line, a first extra charging scan line, a second extra charging scan line, a first extra charge sharing scan line, a second extra charge sharing scan line and a first to a sixth pixel line, the first to the sixth charge sharing scan line correspond to the first to the sixth scan line respectively and correspond to the first to the sixth pixel line respectively, the first scan line is further coupled to the first extra charge sharing scan line, the second scan line is further coupled to the second extra charge sharing scan line, the first charge sharing scan line is further coupled to the third scan line, the second charge sharing scan line is further coupled to the fourth scan line, the third charge sharing scan line is coupled to the fifth scan line, the fourth charge sharing scan line is coupled to the sixth scan line, the fifth charge sharing scan line is coupled to the first extra charging scan line, and the sixth charge sharing scan line is coupled to the second extra charging scan line, wherein the first to the sixth scan line, the first extra charging scan line and the second extra charging scan line receives a signal sequentially.

Wherein, the first and the second transistors of the first to the sixth transistor set are N-type transistors, and the control terminal, the first terminal and the second terminal of the first and the second transistors are gate, source and drain of the N-type transistors, respectively.

The detecting circuit provided by the present invention comprises a first to a third detecting line, a first and a second control line, and a first to a sixth transistor set, the first to the sixth transistor set being coupled to a first to a sixth scan line, wherein each of the transistor sets comprises a first transistor and a second transistor, a control terminal of each first transistor is coupled to the first control line, a first terminal of each first transistor is coupled to one of the first to the third detecting line, a control terminal of each second transistor is coupled to the second control line, a first terminal of each second transistor is coupled to one of the first to the third detecting line, a second terminal of each first transistor is coupled to a second terminal of the second transistor in a same transistor set comprising the coupled first transistor, and is coupled to one of the first to the sixth scan line, each transistor set corresponds to one of the scan lines, and a plurality of connection nodes where the first terminals of the first and second transistors of the first to the sixth transistor set being coupled to the first to the third detecting line compose a set of predetermined point which is [(3,3), (2,2), (3,1), (2,3), (3,2), (2,1)], wherein, in the set of predetermined point, the numerals 1, 2 and 3 represent the first to the third detecting line, a first numeral of a point represents that the first terminal of the first transistor is coupled to the detecting line represented by the first numeral, and a second numeral of the point represents that the first terminal of the second transistor is coupled to the detecting line represented by the second numeral, and abnormal of the display device is detected by controlling to turn on the first or the second transistor through the first and the second control lines. Therefore, the present invention detects the display device effectively and precisely so as to improve the yield of the display device.

BRIEF DESCRIPTION OF THE DRAWINGS

In order to clearly describe the technique solution of the present invention, the figures have to be used in the embodiments would be briefly introduced below. Obviously, the figures described below are only some embodiments of the present invention. Other figures can be obtained from the figures below by those with ordinary skill in the technique field without creative efforts.

DETAILED DESCRIPTION OF PREFERRED EMBODIMENTS

The technique solution in the embodiment of the present invention will be described clearly and thoroughly below in combination with the drawings in the embodiment of the present invention.

Figure 1:
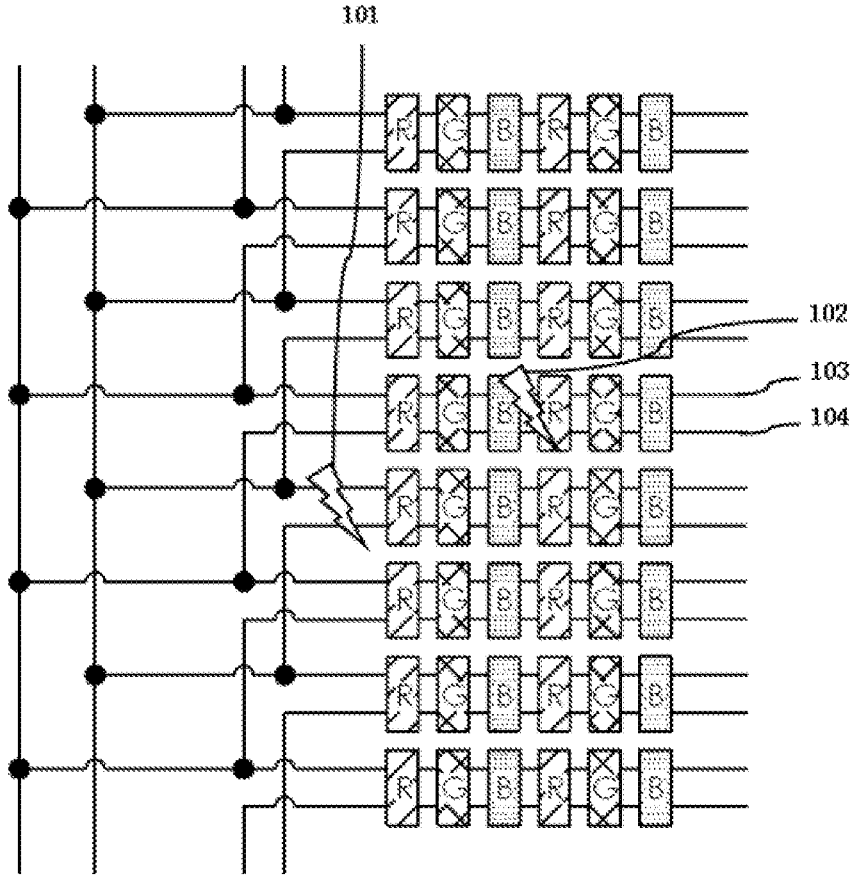
FIG. 1 is a schematic diagram of a conventional display device.
Figure 2:
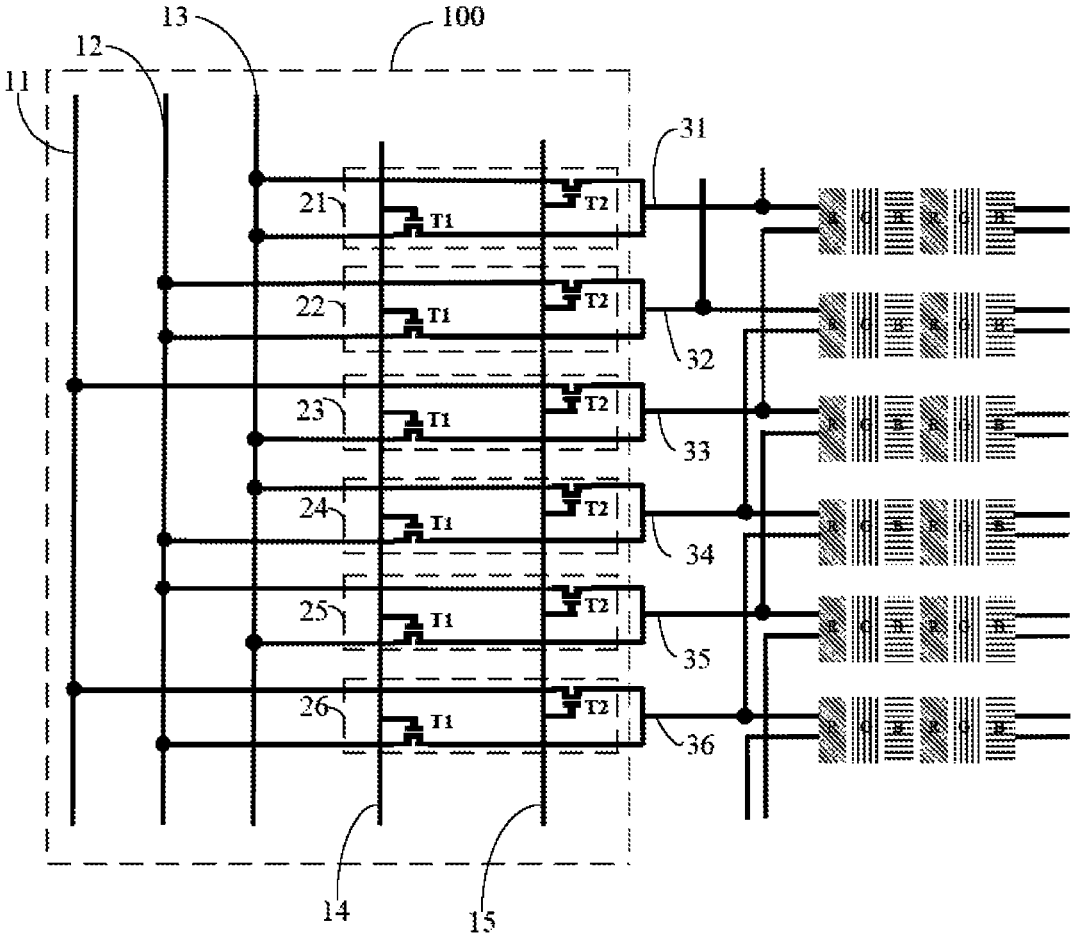
FIG. 2 is a schematic diagram of application of a detecting circuit provided by a preferred embodiment of a first solution of the present invention.

Please refer to FIG. 2. A preferred embodiment of a first embodiment of the present invention provides a detecting circuit 100. The detecting circuit 100 is used to detect a short circuit in a display device. The detecting circuit 100 comprises a first to a third detecting line 11-13, a first and a second control line 14 and 15, and a first to a sixth transistor set 21-26. The first to the sixth transistor set 21-26 is coupled to a first to a sixth scan line 31-36 of the display device. Wherein, each transistor set comprises a first transistor T1 and a second transistor T2. A control terminal of each first transistor T1 is coupled to the first control line 14. A first terminal of each first transistor T1 is coupled to one of the first to the third detecting line 11-13. A control terminal of each second transistor T2 is coupled to the second control line 15. A first terminal of each second transistor T2 is coupled to one of the first to the third detecting line 11-13. A second terminal of each first transistor T1 is coupled to a second terminal of the second transistor T2 in a same transistor set, and is coupled to one of the first to the sixth scan line 31-36. Each transistor set corresponds to one scan line. A plurality of connection nodes where the first terminals of the first and second transistors T1 and T2 of the first to the sixth transistor set 21-26 being coupled to the first to the third detecting line compose a set of predetermined point, which is [(3,3), (2,2), (3,1), (2,3), (3,2), (2,1)]. Wherein, in the set of predetermined point, the numerals 1, 2 and 3 represent the first to the third detecting line. A first numeral of a point represents that the first terminal of the first transistor is coupled to the detecting line represented by the first numeral, and a second numeral of the point represents that the first terminal of the second transistor is coupled to the detecting line represented by the second numeral, and abnormal of the display device is detected by controlling to turn on the first transistor T1 or the second transistor T2 through the first and the second control lines 14 and 15.

It should be noted that, while detecting, the first transistor T1 and the second transistor T2 are controlled by the first and the second control line 14 and 15 so that the status of the first transistor T1 is different from the status of the second transistor T2. That is, the second transistor T2 is turned off when the first transistor T1 is turned on, and the second transistor T2 is turned on when the first transistor T2 is turned off.

In the present embodiment, the first to the sixth scan line 31-36 is the first to the sixth charging scan line. Wherein, in the display device, the display device further comprises a first to a sixth charge sharing scan line and a first to a sixth pixel line. The first charge sharing scan line corresponds to the first charging scan line 31 and the first pixel line. The second charge sharing scan line corresponds to the second charging scan line 32 and the second pixel line. The third charge sharing scan line corresponds to the third charging scan line 33 and the third pixel line. The fourth charge sharing scan line corresponds to the fourth charging scan line 34 and the fourth pixel line. The fifth charge sharing scan line corresponds to the fifth charging scan line 35 and the fifth pixel line. The sixth charge sharing scan line corresponds to the sixth charging scan line 36 and the sixth pixel line. Furthermore, the first to the sixth charge sharing scan line is coupled to a charging scan line after the corresponded charging scan line for an $N^{th}$ even number (N is an integer). When the connection nodes where the first to the sixth scan line 31-36 being coupled to the first to the third detecting line 11-13 compose the set of the predetermined point [(3,3), (2,2), (3,1), (2,3), (3,2), (2,1)], with the first transistor T1 being turned off and the second transistor T2 being turned on by the first and second control line 14 and 15, the charging scan line and the charge sharing scan line, which are short-circuited, can be coupled to different detecting lines. Once there is short circuit, it can be detected by the detecting lines precisely so as to improve the yield of the display device.

Moreover, when detecting other types of abnormal, the first transistor T1 is turned on and the second transistor T2 is turned off by the first and the second control line 14 and 15 to couple the first to the sixth scan line 31-36 to two detecting lines only, so that one of the detecting lines could be left unused and there's no need to detect the display device by using three detecting lines simultaneously so as to save detecting time and improve detecting efficiency. At the same time, when the first detecting line 11 is left unused, there's no need to use the detecting equipment coupled to the first detecting line 11, so that the detecting cost is reduced.

Specifically, the first terminal of the first and the second transistor T1 and T2 of the first transistor set 21 is coupled to the third detecting line 13. The second terminal of the first and the second transistor T1 and T2 of the first transistor set 21 is coupled to the first scan line 31. The first terminal of the first and the second transistor T1 and T2 of the second transistor set 22 is coupled to the second detecting line 12. The second terminal of the first and the second transistor of the second transistor set 22 is coupled to the second scan line 32. The first terminal of the first transistor T1 of the third transistor set 23 is coupled to the third detecting line 13. The first terminal of the second transistor T2 of the third transistor set 23 is coupled to the first detecting line 11. The second terminal of the first and the second transistor T1 and T2 of the third transistor set 23 is coupled to the third scan line 33. The first terminal of the first transistor T1 of the fourth transistor set 24 is coupled to the second detecting line 12. The first terminal of the second transistor T2 of the fourth transistor set 24 is coupled to the third detecting line 13. The second terminal of the first and the second transistor T1 and T2 of the fourth transistor set 24 is coupled to the fourth scan line 34. The first terminal of the first transistor T1 of the fifth transistor set 25 is coupled to the third detecting line 13. The first terminal of the second transistor T2 of the fifth transistor set 25 is coupled to the second detecting line 12. The second terminal of the first and the second transistor T1 and T2 of the fifth transistor set 25 is coupled to the fifth scan line 35. The first terminal of the first transistor T1 of the sixth transistor set 26 is coupled to the second detecting line 12. The first terminal of the second transistor T2 of the sixth transistor set 26 is coupled to the first detecting line 11. The second terminal of the first and the second transistor T1 and T2 of the sixth transistor set 26 is coupled to the sixth scan line 36.

Figure 3:
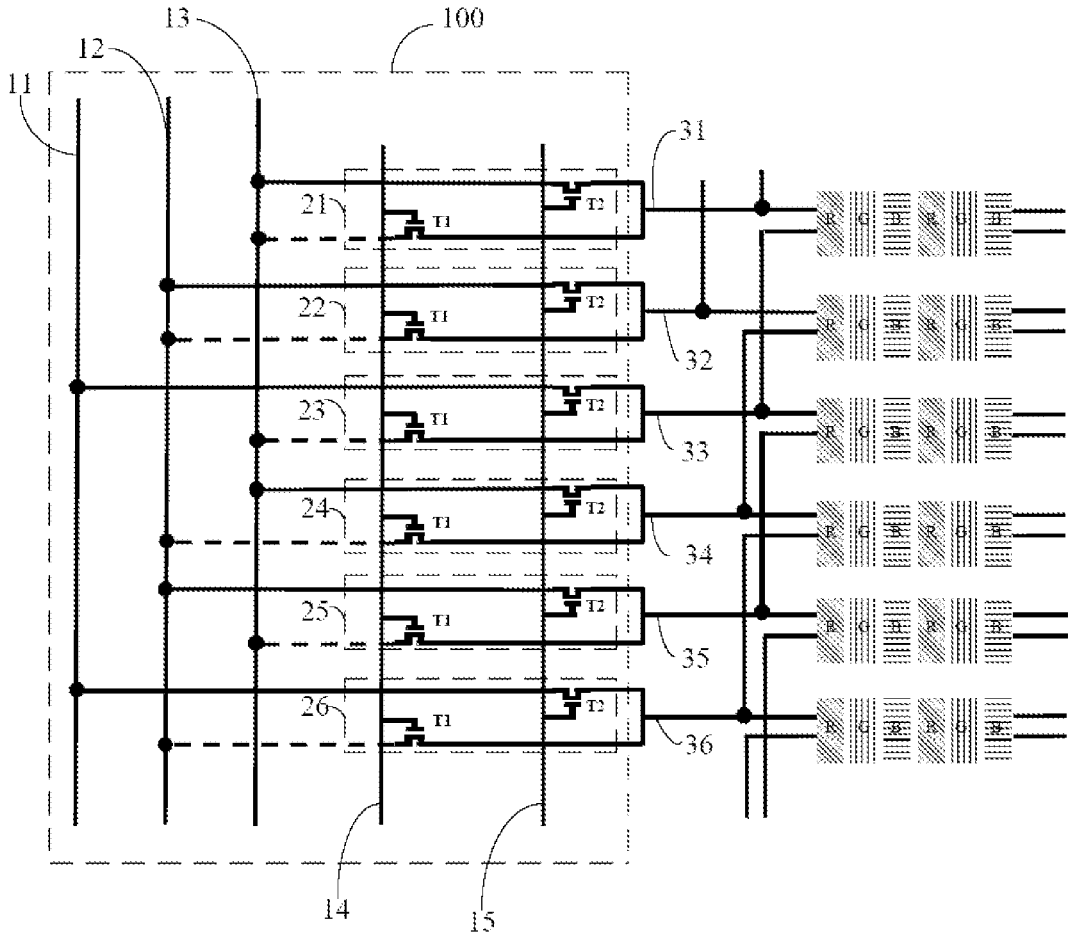
FIG. 3 is a first schematic diagram of a specific example of the detecting circuit provided by the preferred embodiment of the first solution of the present invention.

Please refer to FIG. 3, in which an embodiment is illustrated to show how to detect whether an abnormal of short circuit being existed in a display device. In the beginning of manufacturing the display device, the first transistor T1 is controlled to be turned off and the second transistor T2 is controlled to be turned on by the first and the second control line 14 and 15. The first scan line 31 is coupled to the third detecting line 13, the second scan line 32 is coupled to the second detecting line 12, the third scan line 33 is coupled to the first detecting line 11, the fourth scan line 34 is coupled to the third detecting line 13, the fifth scan line 35 is coupled to the second detecting line 12, and the sixth scan line 36 is coupled to the first detecting line 11. Assuming that the charge sharing scan line corresponded to the first scan line 31 is short-circuited with the first scan line 31, wherein the charge sharing scan line corresponded to the first scan line 31 is coupled to the third scan line 33. At this time, the third scan line 33 is coupled to the first detecting line 11, and the first scan line 31 is coupled to the third detecting line 13. Therefore, short circuit between the first scan line 31 and the corresponded charge sharing scan line can be precisely detected through the first detecting line 11 and the third detecting line 13.

It is noted that, in the present embodiment, the first transistor T1 and the second transistor T2 of the first to the sixth transistor set 21-26 are N-type transistors. The control terminal, the first terminal and the second terminal of the first and the second transistor T1 and T2 are gate, source and drain of the N-type transistor, respectively. The way to control the first transistor T1 to be turned off and the second transistor T2 to be turned on by the first and the second control line 14 and 15 is that the first control line 14 outputs a low level signal to the control terminal of the first transistor T1 and the second control line 15 outputs a high level signal to the control terminal of the second transistor T2 so that the first transistor T1 is turned off and the second transistor T2 is turned on.

For the same reason, when the first transistor T1 and the second transistor T2 of the first to the sixth transistor set 21-26 are P-type transistors, the way to control the first transistor T1 to be turned off and the second transistor T2 to be turned on by the first and the second control line 14 and 15 is that the first control line 14 outputs a high level signal to the control terminal of the first transistor T1 and the second control line 15 outputs a low level signal to the control terminal of the second transistor T2 so that the first transistor T1 is turned off and the second transistor T2 is turned on.

In the present embodiment, the first to the sixth transistor sets 21-26 are aligned along a predetermined direction sequentially. The first to the sixth san line 31-36 are aligned along the predetermined direction sequentially.

It is noted that, the predetermined direction means the sequence in which the first to the sixth scan line receives a detecting signal, i.e. the first to the sixth scan line 31-36 receives the detecting signal sequentially.

Figure 4:
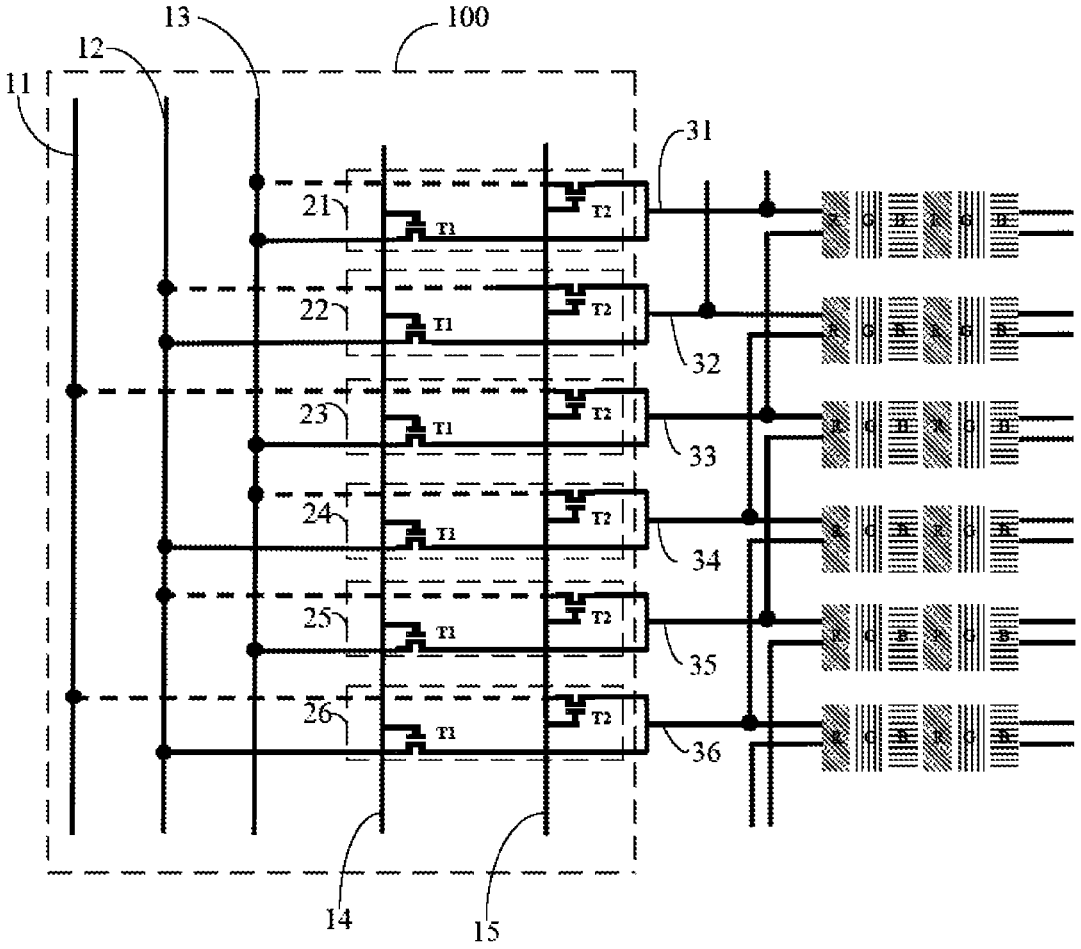
FIG. 4 is a second schematic diagram of a specific example of the detecting circuit provided by the preferred embodiment of the first solution of the present invention.

Please refer to FIG. 4, in which an embodiment is illustrated to describe how to detect abnormal of the display device efficiently. When the condition of manufacturing the display device is stable, the first transistor T1 is turned on and the second transistor T2 is turned off by the first and the second control line 14 and 15. The first scan line 31 is coupled to the third detecting line 13, the second scan line 32 is coupled to the second detecting line 12, the third scan line 33 is coupled to the third detecting line 13, the fourth scan line 34 is coupled to the second detecting line 12, the fifth scan line 35 is coupled to the third detecting line 13, and the sixth scan line 36 is coupled to the second detecting line 12. Accordingly, the display device can be detected through the second and the third detecting line 12 and 13. Therefore, the first detecting line 11 is left unused, and there's no more necessary for using three detecting lines at the same time for detecting the display device, so that the detecting time is saved and the detecting efficiency is improved. At the same time, the first detecting line 11 is left unused to leave the detecting equipment coupled to the first detecting line 11 unused so that the detecting cost is reduced.

It is noted that, in the present embodiment, the first transistor T1 and the second transistor T2 of the first to the sixth transistor set 21-26 are N-type transistors. The control terminal, the first terminal and the second terminal of the first and the second transistor T1 and T2 are gate, source and drain of the N-type transistor, respectively. The way to control the first transistor T1 to be turned on and the second transistor T2 to be turned off by the first and the second control line 14 and 15 is that the first control line 14 outputs a high level signal to the control terminal of the first transistor T1 and the second control line 15 outputs a low level signal to the control terminal of the second transistor T2 so that the first transistor T1 is turned on and the second transistor T2 is turned off.

For the same reason, when the first transistor T1 and the second transistor T2 of the first to the sixth transistor set 21-26 are P-type transistors, the way to control the first transistor T1 to be turned on and the second transistor T2 to be turned off by the first and the second control line 14 and 15 is that the first control line 14 outputs a low level signal to the control terminal of the first transistor T1 and the second control line 15 outputs a high level signal to the control terminal of the second transistor T2 so that the first transistor T1 is turned on and the second transistor T2 is turned off.

It is noted that, besides the first to the sixth charging scan line, the first to the sixth charge sharing scan line and the first to the sixth pixel line, the display device further includes a plurality of charging scan lines, a plurality of charge sharing scan lines and a plurality of pixel lines. The amount of the charging scan line, the charge sharing scan line and the pixel line are the same and correspond to each other one by one. In the present embodiment, the first to the sixth charging scan line are used as a scan line loop unit. Therefore, the display device comprises a plurality of scan line loop units, and each scan line loop unit has the same way to connect to the first to the third detecting line 11-13. It is of course that, in the detecting circuit 100, the first to the sixth transistor set 21-26 are used as a transistor loop unit to correspond to the scan line loop unit. When the display device comprises a plurality of scan line loop units, the detecting circuit 100 also comprises the same amount of the transistor loop units corresponding to the scan line loop units one by one.

Figure 5:
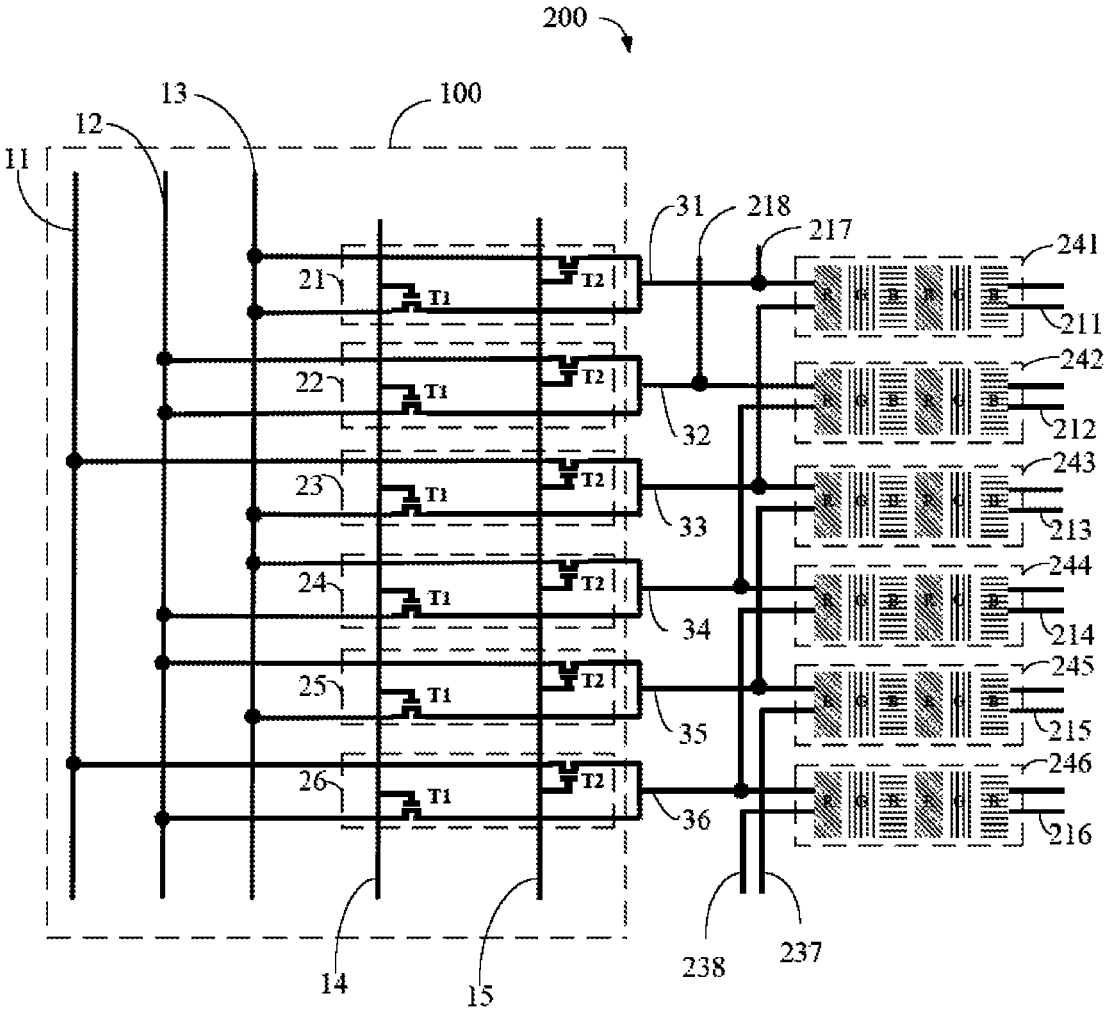
FIG. 5 is a schematic diagram of a display apparatus provided by a preferred embodiment of a second solution of the present invention.

Please refer to FIG. 5. A preferred embodiment of the second solution of the present invention provides a display device 200. The display device 200 comprises the first to the sixth scan line 31-36 and the detecting circuit 100 provided in the first solution mentioned above. The detecting circuit 100 is coupled to the first to the sixth scan line 31-36.

Specifically, the detecting circuit 100 comprises the first to the third detecting line 11-13, the first and the second control line 14 and 15, and the first to the sixth transistor set 21-26. The first to the sixth transistor set 21-26 is coupled to the first to the sixth scan line 31-36 of the display device. Wherein, each transistor set comprises a first transistor T1 and a second transistor T2. The control terminal of each first transistor T1 is coupled to the first control line 14. The first terminal of each first transistor T1 is coupled to one of the first to the third detecting line 11-13. The control terminal of each second transistor T2 is coupled to the second control line 15. The first terminal of each second transistor T2 is coupled to one of the first to the third detecting line 11-13. The second terminal of each first transistor T1 is coupled to the second terminal of the second transistor T2 in a same transistor set, and is coupled to one of the first to the sixth scan line 31-36. Each transistor set corresponds to one scan line. A plurality of connection nodes where the first terminals of the first and second transistors T1 and T2 of the first to the sixth transistor set 21-26 being coupled to the first to the third detecting line compose a set of predetermined point, which is [(3,3), (2,2), (3,1), (2,3), (3,2), (2,1)]. Wherein, in the set of predetermined point, the numerals 1, 2 and 3 represent the first to the third detecting line. A first numeral of a point represents that the first terminal of the first transistor is coupled to the detecting line represented by the first numeral, and a second numeral of the point represents that the first terminal of the second transistor is coupled to the detecting line represented by the second numeral, and abnormal of the display device is detected by controlling to turn on the first transistor T1 or the second transistor T2 through the first and the second control lines 14 and 15.

It should be noted that, while detecting, the first transistor T1 and the second transistor T2 are controlled by the first and the second control line 14 and 15 so that the status of the first transistor T1 is different from the status of the second transistor T2. That is, the second transistor T2 is turned off when the first transistor T1 is turned on, and the second transistor T2 is turned on when the first transistor T2 is turned off.

In the present embodiment, the first to the sixth scan line 31-36 is a first to a sixth charging scan line. The display device 200 further comprises a first to a sixth charge sharing scan line 211-216, a first and a second extra charging scan line 237 and 238, a first and a second extra charge sharing scan line 217 and 218, and a first to a sixth pixel line 241-246. The first to the sixth charge sharing scan lines 211-216 correspond to the first to the sixth scan lines 31-36 respectively and correspond to the first to the sixth pixel lines 241-246 respectively. The first scan line 31 is further coupled to the first extra charge sharing scan line 217. The second scan line 32 is further coupled to the second extra charge sharing scan line 218. The first charge sharing scan line 211 is further coupled to the third scan line 33. The second charge sharing scan line 212 is further coupled to the fourth scan line 34. The third charge sharing scan line 213 is coupled to the fifth scan line 35. The fourth charge sharing scan line 214 is coupled to the sixth scan line 36. The fifth charge sharing scan line 215 is coupled to the first extra charging scan line 237. The sixth charge sharing scan line 216 is coupled to the second extra charging scan line 238. Wherein, the first to the sixth scan line, the first extra charging scan line and the second extra charging scan line receives a signal sequentially.

Specifically, the first charge sharing scan line corresponds to the first charging scan line 31 and the first pixel line. The second charge sharing scan line corresponds to the second charging scan line 32 and the second pixel line. The third charge sharing scan line corresponds to the third charging scan line 33 and the third pixel line. The fourth charge sharing scan line corresponds to the fourth charging scan line 34 and the fourth pixel line. The fifth charge sharing scan line corresponds to the fifth charging scan line 35 and the fifth pixel line. The sixth charge sharing scan line corresponds to the sixth charging scan line 36 and the sixth pixel line. Furthermore, the first to the sixth charge sharing scan line is coupled to a charging scan line after the corresponded charging scan line for an $N^{th}$ even number (N is an integer). When the connection nodes where the first to the sixth scan line 31-36 being coupled to the first to the third detecting line 11-13 compose the set of the predetermined point [(3,3), (2,2), (3,1), (2,3), (3,2), (2,1)], with the first transistor T1 being turned off and the second transistor T2 being turned on by the first and second control line 14 and 15, the charging scan line and the charge sharing scan line, which are short-circuited, can be coupled to different detecting lines. Once there is short circuit, it can be detected by the detecting lines precisely so as to improve the yield of the display device.

Moreover, when detecting other types of abnormal, the first transistor T1 is turned on and the second transistor T2 is turned off by the first and the second control line 14 and 15 to couple the first to the sixth scan line 31-36 to two detecting lines only, so that one of the detecting lines could be left unused, outputting of the detecting signal is reduced, the equipment for coupling the detecting lines is reduced, the detecting cost is reduced, and production capacity is improved.

Specifically, the first terminal of the first and the second transistor T1 and T2 of the first transistor set 21 is coupled to the third detecting line 13. The second terminal of the first and the second transistor T1 and T2 of the first transistor set 21 is coupled to the first scan line 31. The first terminal of the first and the second transistor T1 and T2 of the second transistor set 22 is coupled to the second detecting line 12. The second terminal of the first and the second transistor of the second transistor set 22 is coupled to the second scan line 32. The first terminal of the first transistor T1 of the third transistor set 23 is coupled to the third detecting line 13. The first terminal of the second transistor T2 of the third transistor set 23 is coupled to the first detecting line 11. The second terminal of the first and the second transistor T1 and T2 of the third transistor set 23 is coupled to the third scan line 33. The first terminal of the first transistor T1 of the fourth transistor set 24 is coupled to the second detecting line 12. The first terminal of the second transistor T2 of the fourth transistor set 24 is coupled to the third detecting line 13. The second terminal of the first and the second transistor T1 and T2 of the fourth transistor set 24 is coupled to the fourth scan line 34. The first terminal of the first transistor T1 of the fifth transistor set 25 is coupled to the third detecting line 13. The first terminal of the second transistor T2 of the fifth transistor set 25 is coupled to the second detecting line 12. The second terminal of the first and the second transistor T1 and T2 of the fifth transistor set 25 is coupled to the fifth scan line 35. The first terminal of the first transistor T1 of the sixth transistor set 26 is coupled to the second detecting line 12. The first terminal of the second transistor T2 of the sixth transistor set 26 is coupled to the first detecting line 11. The second terminal of the first and the second transistor T1 and T2 of the sixth transistor set 26 is coupled to the sixth scan line 36.

In the present embodiment, the first to the sixth transistor sets 21-26 are aligned along a predetermined direction sequentially. The first to the sixth san line 31-36 are aligned along the predetermined direction sequentially.

It is noted that, the predetermined direction means the sequence in which the first to the sixth scan line 31-36 receives a detecting signal, i.e. the first to the sixth scan line 31-36 receives the detecting signal sequentially.

It is noted that, besides the first to the sixth charging scan line 31-36, the first to the sixth charge sharing scan line 211-216 and the first to the sixth pixel line 241-246, the display device 200 further includes a plurality of charging scan lines, a plurality of charge sharing scan line and a plurality of pixel lines. The amount of the charging scan line, the charge sharing scan line and the pixel line are the same and correspond to each other one by one. In the present embodiment, the first to the sixth charging scan line are used as a scan line loop unit. Therefore, the display device 200 comprises a plurality of scan line loop units, and each scan line loop unit has the same way to connect to the first to the third detecting line 11-13. It is of course that, in the detecting circuit 100, the first to the sixth transistor set 21-26 are used as a transistor loop unit to correspond to the scan line loop unit. When the display device 200 comprises a plurality of scan line loop units, the detecting circuit 100 also comprises the same amount of the transistor loop units corresponding to the scan line loop units one by one.

In the present embodiment, the first transistor T1 and the second transistor T2 of the first to the sixth transistor set 21-26 are N-type transistors. The control terminal, the first terminal and the second terminal of the first and the second transistor T1 and T2 are gate, source and drain of the N-type transistor, respectively.

Those described above are the preferred embodiment of the present invention. It is noted that, for those with ordinary skill in the technique field, a plurality of improvements and modifications can be made within the technique theory of the present invention, and these improvements and modifications are also a part of the protection scope of the present invention.

What is claimed is:

1. A detecting circuit for detecting abnormalities in a display device, wherein the detecting circuit comprises a first detecting line, a second detecting line, a third detecting line, a first control line, a second control line, a first transistor set, a second transistor set, a third transistor set, a fourth transistor set, a fifth transistor set and a sixth transistor set, the first to the sixth transistor set is coupled to a first scan line, a second scan line, a third scan line, a fourth scan line, a fifth scan line or a sixth scan line, wherein each of the transistor sets comprises a first transistor and a second transistor, a control terminal of each first transistor is coupled to the first control line, a first terminal of each first transistor is coupled to one of the first to the third detecting line, a control terminal of each second transistor is coupled to the second control line, a first terminal of each second transistor is coupled to one of the first to the third detecting line, a second terminal of each first transistor is coupled to a second terminal of the second transistor in a same transistor set comprising the coupled first transistor, and is coupled to one of the first to the sixth scan line, each transistor set corresponds to one of the scan lines, and a plurality of connection nodes where the first terminals of the first and second transistors of the first to the sixth transistor set being coupled to the first to the third detecting line compose a set of predetermined points which are [(3,3), (2,2), (3,1), (2,3), (3,2), (2,1)], wherein, in the set of predetermined points, the numerals 1, 2 and 3 represent the first to the third detecting line, a first numeral of a point represents that the first terminal of the first transistor is coupled to the detecting line represented by the first numeral, and a second numeral of the point represents that the first terminal of the second transistor is coupled to the detecting line represented by the second numeral, and abnormalities of the display device are detected by turning on turn on the first or the second transistor through the first and the second control lines.

2. The detecting circuit according to claim 1, wherein the first terminals of the first and the second transistors of the first transistor set are coupled to the third detecting line, the second terminals of the first and the second transistors of the first transistor set are coupled to the first scan lines, the first terminals of the first and the second transistors of the second transistor set are coupled to the second detecting line, the second terminals of the first and the second transistor of the second transistor set are coupled to the second scan line, the first terminal of the first transistor of the third transistor set is coupled to the third detecting line, the first terminal of the second transistor of the third transistor set is coupled to the first detecting line, the second terminals of the first and the second transistors of the third transistor set are coupled to the third scan line, the first terminal of the first transistor of the fourth transistor set is coupled to the second detecting line, the first terminal of the second transistor of the fourth transistor set is coupled to the third detecting line, the second terminals of the first and the second transistors of the fourth transistor set are coupled to the fourth scan line, the first terminal of the first transistor of the fifth transistor set is coupled to the third detecting line, the first terminal of the second transistor of the fifth transistor set is coupled to the second detecting line, the second terminals of the first and the second transistors of the fifth transistor set are coupled to the fifth scan line, the first terminal of the first transistor of the sixth transistor set is coupled to the second detecting line, the first terminal of the second transistor of the sixth transistor set is coupled to the first detecting line, and the second terminals of the first and the second transistors of the sixth transistor set are coupled to the sixth scan line.

3. The detecting circuit according to claim 2, wherein the first to the sixth transistor sets are aligned along a predetermined direction sequentially, and the first to the sixth scan lines are aligned along the predetermined direction sequentially.

4. The detecting circuit according to claim 2, wherein the first and the second transistors of the first to the sixth transistor set are N-type transistors, and the control terminal, the first terminal and the second terminal of the first and the second transistors are gate, source and drain of the N-type transistors, respectively.

5. The detecting circuit according to claim 1, wherein the first to the sixth scanline is a first to a sixth charging scan line.

6. A display device comprising a first scan line, a second scan line, a third scan line, a fourth scan line, a fifth scan line, a sixth scan line, a first detecting line, a second detecting line, a third detecting line, a first control line, a second control line, a first transistor set, a second transistor set, a third transistor set, a fourth transistor set, a fifth transistor set and a sixth transistor set, the first to the sixth transistor set being coupled to the first to the sixth scan line, wherein each of the transistor sets comprises a first transistor and a second transistor, a control terminal of each first transistor is coupled to the first control line, a first terminal of each first transistor is coupled to one of the first to the third detecting line, a control terminal of each second transistor is coupled to the second control line, a first terminal of each second transistor is coupled to one of the first to the third detecting line, a second terminal of each first transistor is coupled to a second terminal of the second transistor in a same transistor set comprising the coupled first transistor, and is coupled to one of the first to the sixth scan line, each transistor set corresponds to one of the scan lines, and a plurality of connection nodes where the first terminals of the first and second transistors being coupled to the first to the third detecting line compose a set of predetermined points which is [(3,3), (2,2), (3,1), (2,3), (3,2), (2,1)], wherein, in the set of predetermined points, the numerals 1, 2 and 3 represent the first to the third detecting line, a first numeral of a point represents that the first terminal of the first transistor is coupled to the detecting line represented by the first numeral, and a second numeral of the point represents that the first terminal of the second transistor is coupled to the detecting line represented by the second numeral, and abnormalities of the display device are detected by turning on the first or the second transistor through the first and the second control lines.

7. The display apparatus according to claim 6, wherein the first terminals of the first and the second transistors of the first transistor set are coupled to the third detecting line, the second terminals of the first and the second transistors of the first transistor set are coupled to the first scan lines, the first terminals of the first and the second transistors of the second transistor set are coupled to the second detecting line, the second terminals of the first and the second transistor of the second transistor set are coupled to the second scan line, the first terminal of the first transistor of the third transistor set is coupled to the third detecting line, the first terminal of the second transistor of the third transistor set is coupled to the first detecting line, the second terminals of the first and the second transistors of the third transistor set are coupled to the third scan line, the first terminal of the first transistor of the fourth transistor set is coupled to the second detecting line, the first terminal of the second transistor of the fourth transistor set is coupled to the third detecting line, the second terminals of the first and the second transistors of the fourth transistor set are coupled to the fourth scan line, the first terminal of the first transistor of the fifth transistor set is coupled to the third detecting line, the first terminal of the second transistor of the fifth transistor set is coupled to the second detecting line, the second terminals of the first and the second transistors of the fifth transistor set are coupled to the fifth scan line, the first terminal of the first transistor of the sixth transistor set is coupled to the second detecting line, the first terminal of the second transistor of the sixth transistor set is coupled to the first detecting line, and the second terminals of the first and the second transistors of the sixth transistor set are coupled to the sixth scan line.

8. The display device according to claim 7, wherein the first to the sixth transistor sets are aligned along a predetermined direction sequentially, and the first to the sixth scan lines are aligned along the predetermined direction sequentially.

9. The display device according to claim 8, wherein the first to the sixth scan line is a first to a sixth charging scan line, the display device further comprises a first to a sixth charge sharing scan line, a first extra charging scan line, a second extra charging scan line, a first extra charge sharing scan line, a second extra charge sharing scan line and a first to a sixth pixel line, the first to the sixth charge sharing scan line correspond to the first to the sixth scan line respectively and correspond to the first to the sixth pixel line respectively, the first scan line is further coupled to the first extra charge sharing scan line, the second scan line is further coupled to the second extra charge sharing scan line, the first charge sharing scan line is further coupled to the third scan line, the second charge sharing scan line is further coupled to the fourth scan line, the third charge sharing scan line is coupled to the fifth scan line, the fourth charge sharing scan line is coupled to the sixth scan line, the fifth charge sharing scan line is coupled to the first extra charging scan line, and the sixth charge sharing scan line is coupled to the second extra charging scan line, wherein the first to the sixth scan line, the first extra charging scan line and the second extra charging scan line receives a signal sequentially.

10. The display device according to claim 7, wherein the first and the second transistors of the first to the sixth transistor set are N-type transistors, and the control terminal, the first terminal and the second terminal of the first and the second transistors are gate, source and drain of the N-type transistors, respectively.

* * * * *